US008401436B2

(12) United States Patent
Sakamoto et al.

(10) Patent No.: US 8,401,436 B2
(45) Date of Patent: Mar. 19, 2013

(54) DEVELOPER CONTAINER AND IMAGE FORMING APPARATUS USING THE SAME

(75) Inventors: Takashi Sakamoto, Kanagawa (JP); Ryuji Hattori, Kanagawa (JP); Toshikazu Tsumita, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 280 days.

(21) Appl. No.: 12/961,971

(22) Filed: Dec. 7, 2010

(65) Prior Publication Data

US 2012/0003013 A1 Jan. 5, 2012

(30) Foreign Application Priority Data

Jul. 1, 2010 (JP) ..... P2010-151419

(51) Int. Cl.
*G03G 15/08* (2006.01)

(52) U.S. Cl. ..... 399/258; 399/260; 399/262

(58) Field of Classification Search ..... 399/107, 399/111, 119, 120, 252, 258–263; 222/DIG. 1
See application file for complete search history.

(56) References Cited

U.S. PATENT DOCUMENTS

| | | | | |
|---|---|---|---|---|
| 7,715,765 | B2 * | 5/2010 | Ichikawa et al. | 399/258 |
| 7,792,470 | B2 * | 9/2010 | Eto et al. | 399/263 |
| 7,805,092 | B2 * | 9/2010 | Mihara | 399/106 |
| 7,853,183 | B2 * | 12/2010 | Taguchi et al. | 399/262 |

FOREIGN PATENT DOCUMENTS

| | | |
|---|---|---|
| JP | 11-65246 | 3/1999 |
| JP | 2005-134452 | 5/2005 |

* cited by examiner

*Primary Examiner* — Hoan Tran
(74) *Attorney, Agent, or Firm* — Sughrue Mion, PLLC

(57) ABSTRACT

A developer container is provided with a container body. An opening is formed through the container body. An opening/closing lid closes the opening. A lid holding frame holds the opening/closing lid in such a manner that the opening/closing lid can move between an open position and a closed position. A stopper stops the opening/closing lid and thereby preventing it from moving toward the open position in a state that the opening/closing lid is located at the closed position. A contact portion comes into contact with a hook portion provided in a container receiving portion when the developer container is inserted into the container receiving portion. A deformable portion deforms the stopper to such an extent that the stopping of the opening/closing lid by the stopper is canceled when the developer container is inserted into the container receiving portion and the contact portion comes into contact with the hook portion.

6 Claims, 17 Drawing Sheets

DEVELOPER CONTAINER AND IMAGE FORMING APPARATUS USING THE SAME

CROSS-REFERENCE TO RELATED APPLICATIONS

This application is based on and claims priority under 35 USC 119 from Japanese Patent Application No. 2010-151419 filed on Jul. 1, 2010.

BACKGROUND

Technical Field

The present invention relates to a developer container and an image forming apparatus using the same.

SUMMARY

According to an aspect of the invention, a developer container which contains developer and is to be inserted into and detached from a container receiving portion of an image forming apparatus body, includes: a container body that contains developer; an opening that is formed through the container body; an opening/closing lid that closes the opening; a lid holding frame that holds the opening/closing lid in such a manner that the opening/closing lid can move in an opening/closing manipulation direction between an open position where the opening/closing lid exposes the opening and a closed position where the opening/closing lid closes the opening; a stopper that stops the opening/closing lid to prevent the opening/closing lid from moving toward the open position in a state that the opening/closing lid is located at the closed position; a contact portion that comes into contact with a hook portion provided in the container receiving portion when the developer container is inserted into the container receiving portion; and a deformable portion that deforms the stopper to such an extent that the stopping of the opening/closing lid by the stopper is canceled when the developer container is inserted into the container receiving portion and the contact portion comes into contact with the hook portion.

BRIEF DESCRIPTION OF THE DRAWINGS

Exemplary embodiment(s) of the present invention will be described in detail based on the following figures, wherein.

DETAILED DESCRIPTION

Outline of Exemplary Embodiments

Figure 1A:
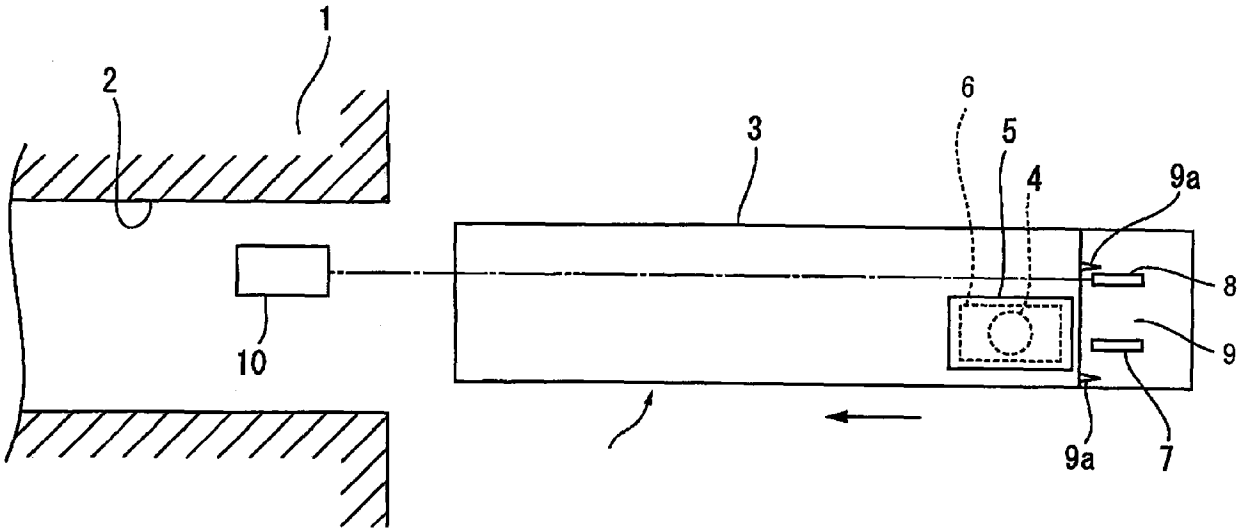
FIG. 1A outlines a developer container according to embodiments of the present invention.
Figure 1B:
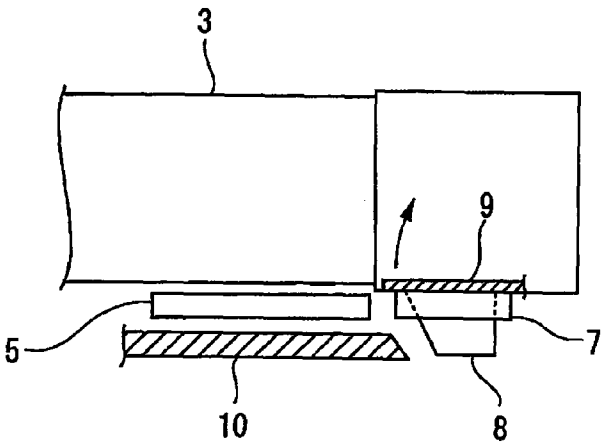
FIG. 1B schematically illustrates how the developer container of FIG. 1A behaves when it is inserted into a container receiving portion.

FIG. 1A is a schematic diagram outlining a developer container 11 according to embodiments of the present invention. FIG. 1B illustrates how the developer container 11 behaves when it is inserted into a container receiving portion 2.

In FIGS. 1A and 1B, the developer container 11 contains developer and is to be inserted into and detached from the container receiving portion 2 of an image forming apparatus body 1. The developer container 11 is provided with a container body 3 which contains the developer, an opening 4 which is formed through the container body 3, an opening/closing lid 5 for closing the opening 4, a lid holding frame 6 which holds the opening/closing lid 5 in such a manner that the opening/closing lid 5 can move in an opening/closing manipulation direction between an open position where the opening/closing lid 5 exposes the opening 4 and a closed position where the opening/closing lid 5 closes the opening 4, a stopper 7 for stopping the opening/closing lid 5 and thereby preventing it from moving toward the open position in a state that the opening/closing lid 5 is located at the closed position, a contact portion 8 which comes into contact with a hook portion 10 provided in the container receiving portion 2 when the developer container 11 is inserted into the container receiving portion 2, and a deformable portion 9 for deforming the stopper 7 to such an extent that the stopping of the opening/closing lid 5 by the stopper 7 is canceled when the developer container 11 is inserted into the container receiving portion 2 and the contact portion 8 comes into contact with the hook portion 10.

In the above-configured developer container 11, the stopper 7 may be in any form as long as it can stop the opening/closing lid 5 and thereby prevent it from being opened in a state that the developer container 11 is not attached. The contact portion 8 is required to come into contact with the hook portion 10 provided in the container receiving portion 2 when the developer container 11 is inserted. The deformable portion 9 may be such as to deform the stopper 7 and thereby move it from a stopping position to a stopping cancellation position when the developer container 11 is inserted into the container receiving portion 2 and the contact portion 8 comes into contact with the hook portion 10.

Exemplary forms of the developer container 11 are as follows.

For example, the stopper 7 and the contact portion 8 are to be formed in a common deformable portion 9.

And, the deformable portion 9 is a plate piece which is deformable because it is located between cuts 9*a* formed in the container body 3.

The stopper 7 and the contact portion 8 may be provided either separately or as a common member. The stopper 7 may be lower than the contact portion 8 so that the stopper 7 is rendered incapable of contacting the opening/closing lid 5 when (i) the contact portion 8 comes into contact with the hook portion 10 of the container receiving portion 2 and (ii) the deformable portion 9 is thereby deformed.

The embodiments are applied to not only the developer container 11 but also an image forming apparatus which is equipped with the image forming apparatus body 1 and the developer container 11 which contains developer and is to be inserted into and detached from the container receiving portion 2 of the image forming apparatus body 1.

In the latter application form, it suffices that the developer container 11 be provided with the above-described container body 3, the opening 4, the opening/closing lid 5, the lid holding frame 6, the stopper 7, the contact portion 8, and the deformable portion 9. On the other hand, it suffices that the container receiving portion 2 of the image forming apparatus body 1 be provided with a lid guiding member (not shown) for guiding the opening/closing lid 5 of the developer container 11 as it is moved, the hook portion 10 which comes into contact with the contact portion 8 and thereby deforms it when the developer container 11 is inserted into the container receiving portion 2, a lid opening maintaining means (not shown) for holding the opening/closing lid 5 after moving it to the open position by contacting it in completing the insertion of the developer container 11, and a lid holding canceling means (not shown) for canceling the state that the opening/closing lid 5 is held by the lid opening maintaining means when the opening/closing lid 5 has reached the closed position in detaching the developer container 11.

The embodiments of the invention will be hereinafter described in more detail with reference to the accompanying drawings.

First Embodiment

Whole Configuration of Image Forming Apparatus

Figure 2:
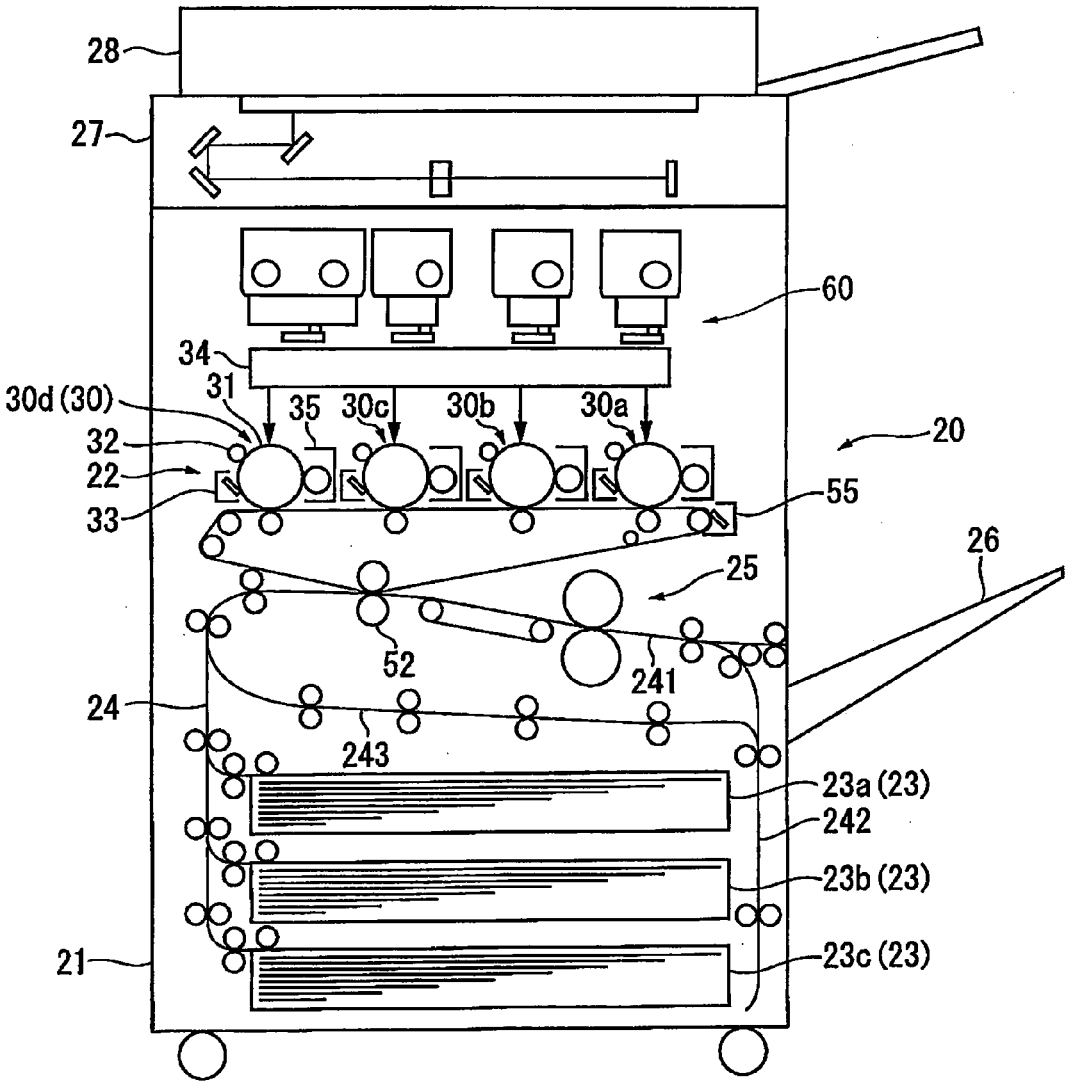
FIG. 2 shows the whole configuration of an image forming apparatus according to a first embodiment of the invention.

FIG. 2 shows the whole configuration of an image forming apparatus according to the first embodiment of the invention.

As shown in FIG. 2, in the image forming apparatus 20, an electrophotographic image forming engine 22 is provided inside an apparatus cabinet 21. Plural sheet supply devices 23 (23*a*-23*c*) are disposed under the image forming engine 22. A sheet S that is supplied from one of the sheet supply devices 23 is guided to the image forming engine 22 via a sheet conveyance path 24. Images formed by the image forming engine 22 are transferred to the sheet S and fused in a fusing device 25. Then, the sheet is ejected to an ejected sheet tray 26 which is provided on one side of the apparatus cabinet 21.

In the image forming apparatus 20 according to the first embodiment, a document reading device 27 such as a scanner occupies a top space of the apparatus cabinet 21 and is added with an automatic document feeder 28.

The sheet conveyance path 24 has a main conveyance path 241 for guiding, to the image forming engine 22, a sheet S that is supplied from one of the sheet supply devices 23 and conveying the sheet S to the ejected sheet tray 26 past the fusing device 25, a generally Y-shaped flipping conveyance path 242 for flipping a sheet S downstream of the fusing device 25, and a sheet return conveyance path 243 for returning the sheet S that has been flipped by the flipping conveyance path 242 to the main conveyance path 241 to enable on both surfaces of the sheet S. Conveying members such as a proper number of conveying rolls 244 and a conveying belt 245 are disposed along the sheet conveyance path 24.

<Image Forming Engine>

Figure 3:
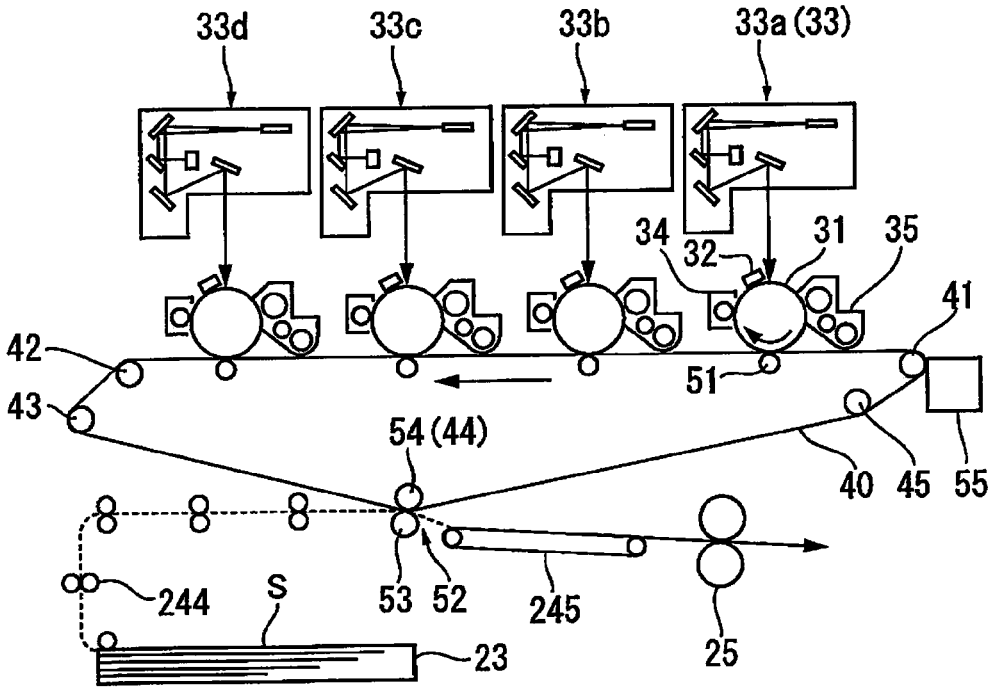
FIG. 3 shows an example image forming engine used in the first embodiment.

In the first embodiment, as shown in FIGS. 2 and 3, the image forming engine 22 has plural image forming units 30 (30*a*-30*d*) capable of forming images of respective color components (e.g., yellow (Y), magenta (M), cyan (C), and black (K)). Images of toners (powders) are formed on a belt-shaped intermediate transfer body 40 in the image forming units 30 and then transferred to a sheet S. The toner images are fused on the sheet S in the fusing device 25.

Each image forming unit 30 is equipped with a photoreceptor body (image holding body) 31, a charging device 32 for charging the photoreceptor body 31, a latent image writing device 33 (33*a*, 33*b*, 33*c*, or 33*d*) such as a laser scanning device for writing, using light, a latent image on the photoreceptor body 31 that has been charged by the charging device 32, a developing device 34 for developing the latent image written on the photoreceptor body 31 using a toner of the corresponding color, and a cleaning device 35 for cleaning residues (e.g., toner) remaining on the photoreceptor body 31.

On the other hand, the belt-shaped intermediate transfer body 40 is stretched by means of plural stretching rolls 41-45 and circulated with the stretching roll 41, for example, as a drive roll. The intermediate transfer body 40 is provided, on its back surface side, with primary transfer devices (e.g., primary transfer rolls) 51 which are opposed to the photoreceptor bodies 31 of the image forming units 30, respectively. The intermediate transfer body 40 is also provided a secondary transfer device 52 at a position in a region that is adjacent to the main conveyance path 241 of the sheet conveyance path 24. For example, the secondary transfer device 52 is configured in such a manner that a secondary transfer roll 53 is disposed so as to be in contact with the surface of the intermediate transfer body 40 and the stretching roll 44 which is disposed on the back surface side of the intermediate transfer body 40 so as to be opposed to the secondary transfer roll 53 serves as a counter roll (backup roll) 54. A secondary transfer bias is applied to one of the secondary transfer roll 53 and the counter roll 54 and the other is grounded.

A cleaning device 55 is disposed at such a position as to be opposed to, for example, the stretching roll 41 for the intermediate transfer body 40.

<Toner Supply Devices>

In the first embodiment, toner supply devices 60 for supplying toners (powders) of the respective color components are provided.

Figure 4:
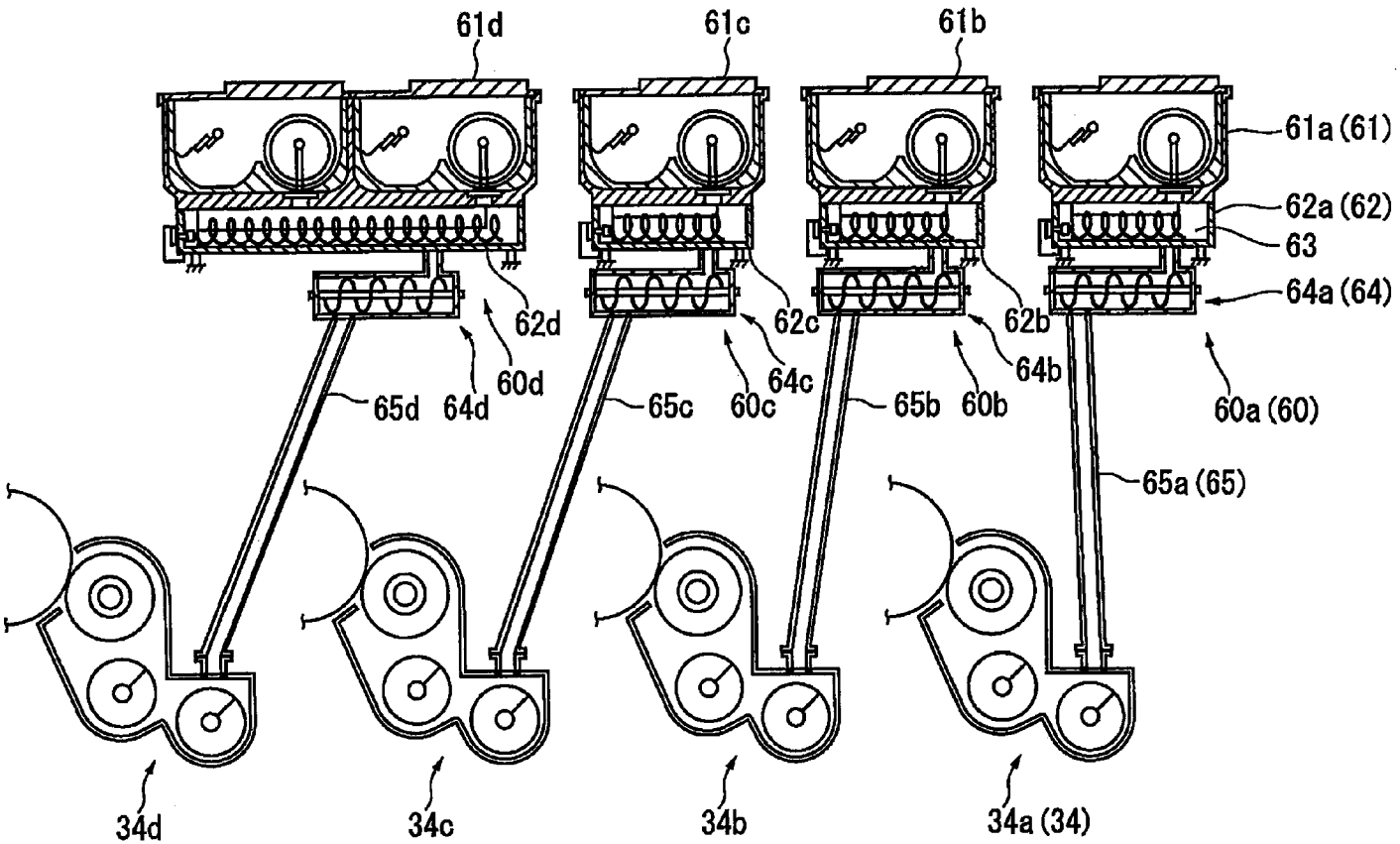
FIG. 4 shows example toner supply devices used in the first embodiment.

As shown in FIG. 4, each of the toner supply devices 60 (60*a*-60*d*) is equipped with a toner cartridge 61 (61*a*, 61*b*, 61*c*, or 61*d*) as a container which contains a toner (powder) inside, a cartridge receiving portion 62 (62*a*, 62*b*, 62*c*, or 62*d*) to which the toner cartridge 61 is attached, and a connection pipe 65 (65*a*, 65*b*, 65*c*, or 65*d*) which connects the developing device 34 (34*a*, 34*b*, 34*c*, or 34*d*) of the corresponding image forming section 30 and the cartridge receiving portion 62.

In particular, the cartridge receiving portion 62 has a reserve tank 63 for temporarily storing toner that is supplied from the toner cartridge 61 and a powder transport device 64 (64*a*, 64*b*, 64*c*, or 64*d*) is disposed between the reserve tank 63 and the connection pipe 65.

In this example, the toner cartridge 61*d*, containing the black toner which is used more frequently than the other toners, has a two-room structure and hence has a larger capacity than the other toner cartridges 61*a*-61*c*.

<Toner Cartridges>

Figure 5:
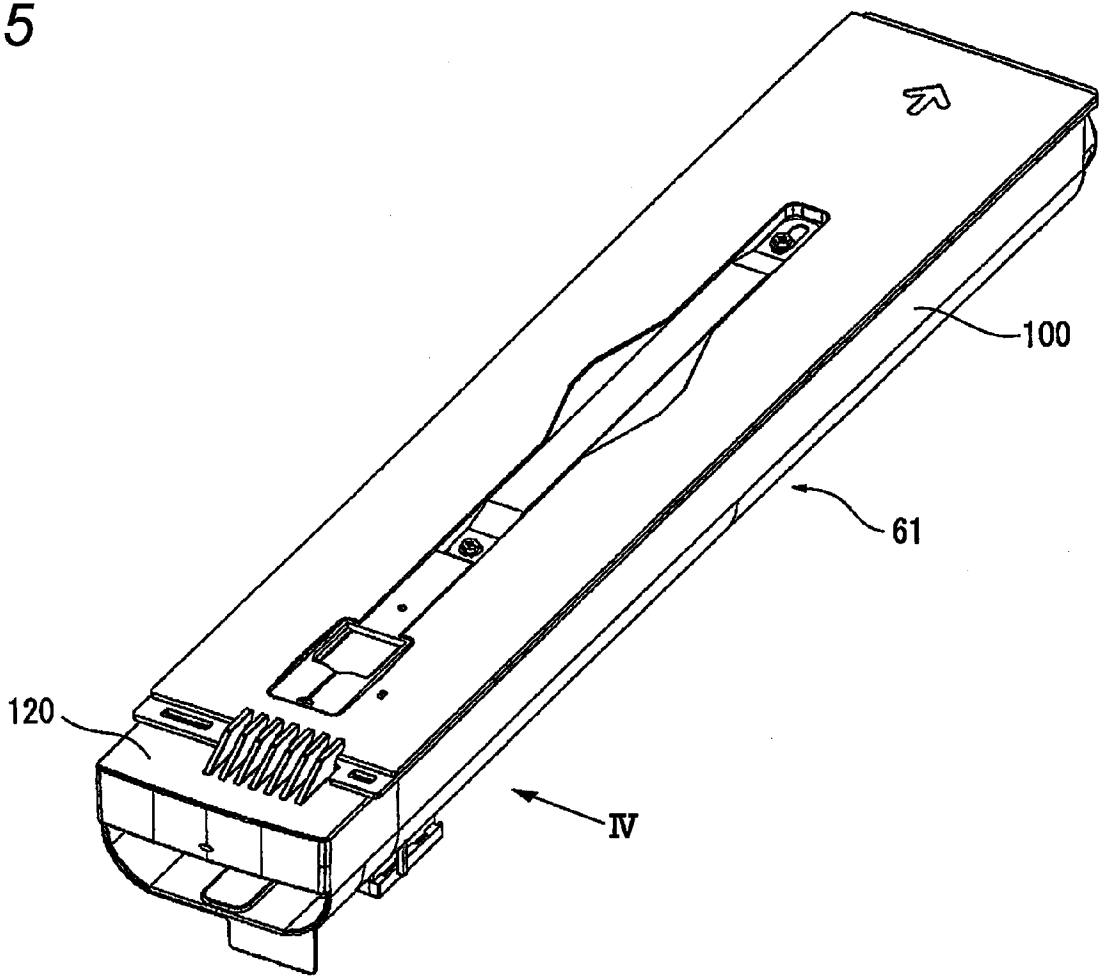
FIG. 5 shows an appearance of an example of a developer container used in the first embodiment.
Figure 6:
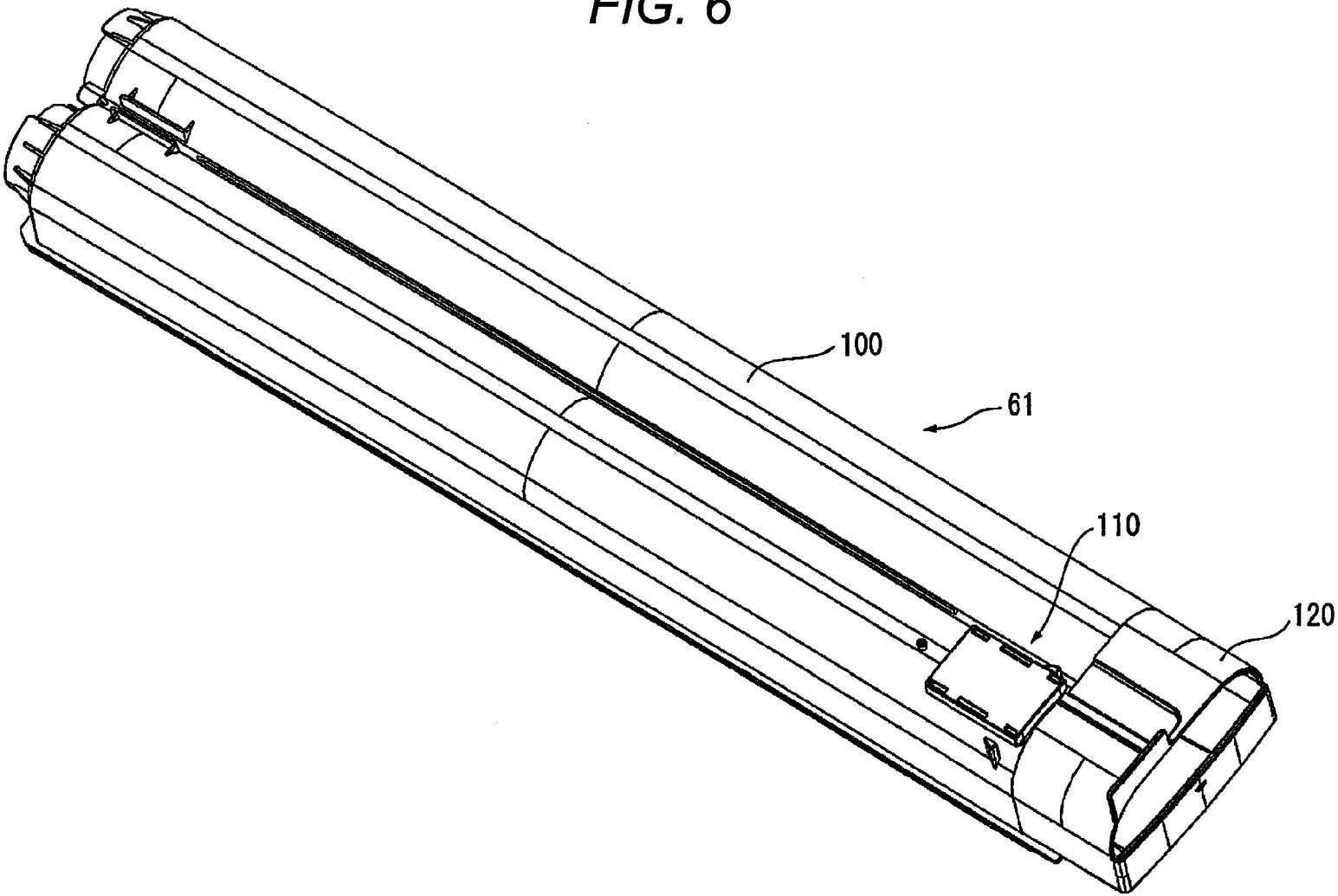
FIG. 6 is a view of the developer container as viewed from the direction VI in FIG. 5.

As shown in FIGS. 5 and 6, in each toner cartridge 61, one side wall of a container body 100 is provided with a shutter 110 near the front end portion of the container body 100 (the lid holding frame having the opening is provided with the opening/closing lid which can be opened and closed). And the container body 100 is provided, at its front end portion, with a handle 120 (gripping portion) to be gripped in inserting or detaching the toner cartridge 61.

<Cartridge Receiving Portions>

Figure 7:
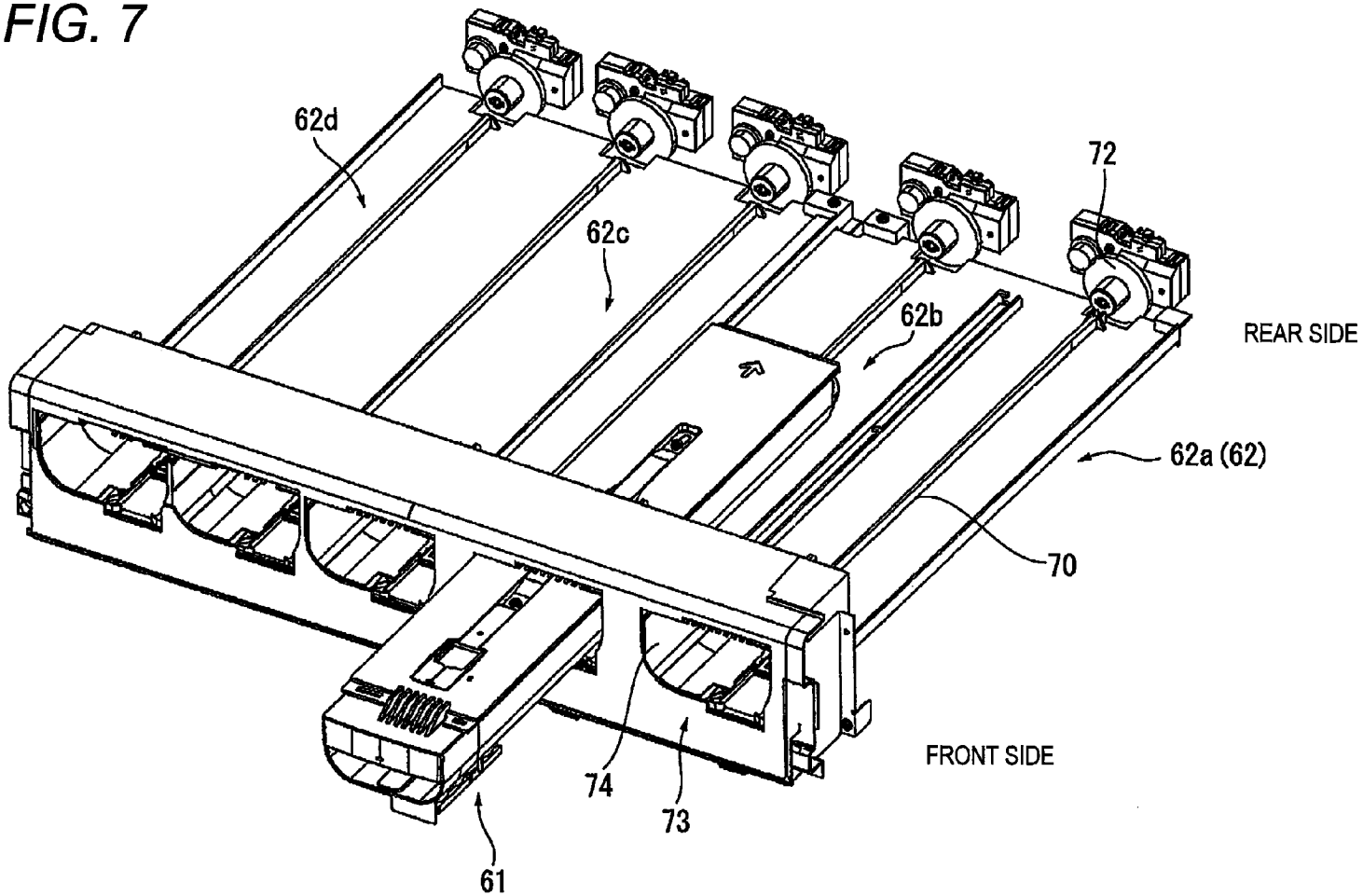
FIG. 7 shows container the container receiving portions of the image forming apparatus body of the first embodiment.
Figure 8:
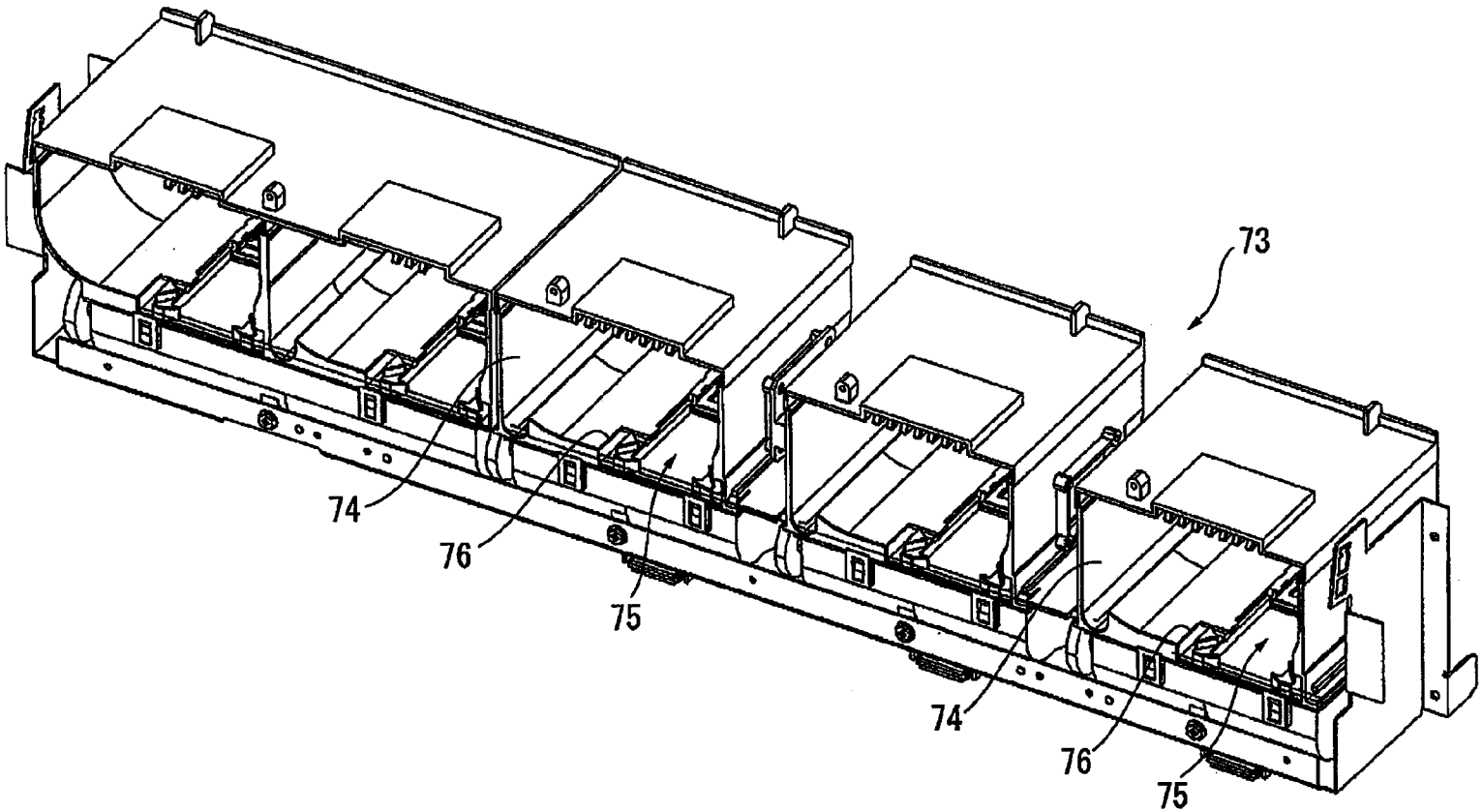
FIG. 8 shows details of the container receiving portions of FIG. 7.
Figure 9:
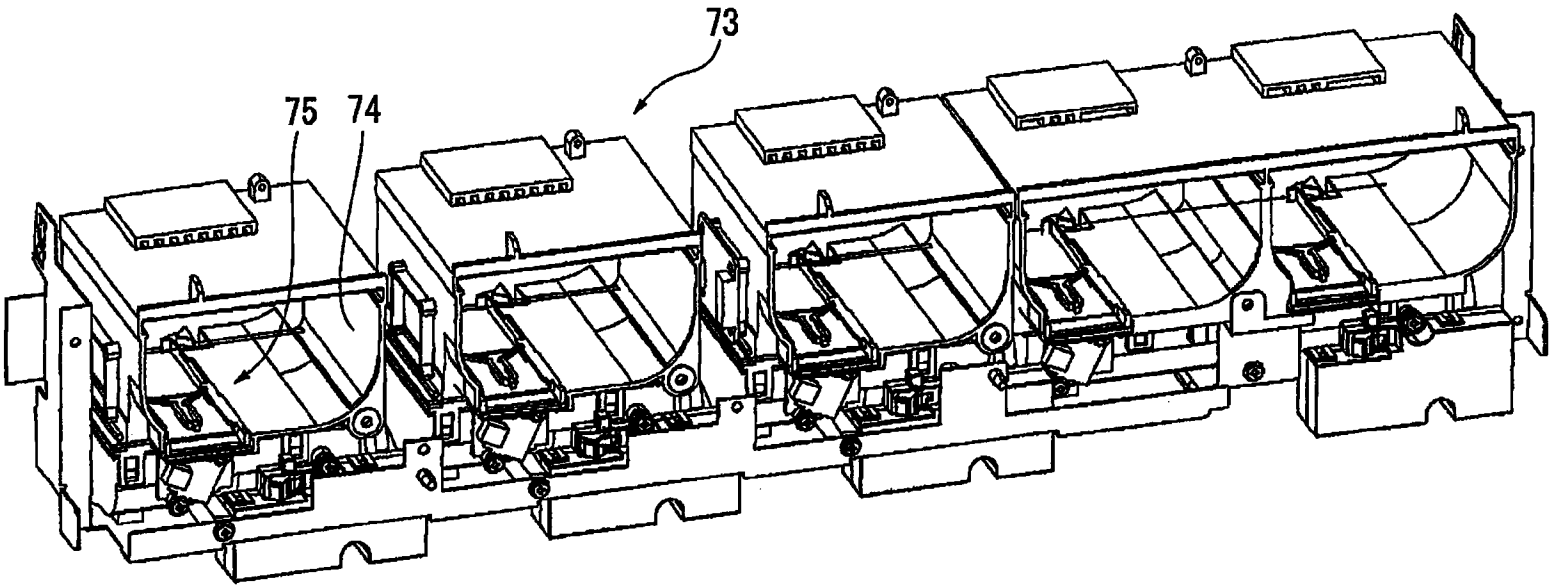
FIG. 9 shows the container receiving portions as viewed from the back side in FIG. 8.

In the first embodiment, as shown in FIG. 7, each of the cartridge receiving portions 62 (62*a*-62*d*) has a guide rail 70 for guiding the corresponding toner cartridge 61 (61*a*, 61*b*, 61*c*, or 61*d*). A coupling joint 72 which is engaged with the end portion of an agitator (agitating member) incorporated in the toner cartridge 61 and thereby gives rotational drive power to the agitator is provided at the rear end. A support box 73 to be engaged with the shutter 110 of the toner cartridge 61 is provided at the front end.

The support box 73 has a insertion hole 74 in which the toner cartridge 61 is inserted. A bottom portion of the insertion hole 74 is provided with an opening/closing mechanism 75 to be engaged with the shutter 110 of the toner cartridge 61. An entrance-side bottom portion of the insertion hole 74 is formed with a hook portion which is a step portion.

Figure 10A:
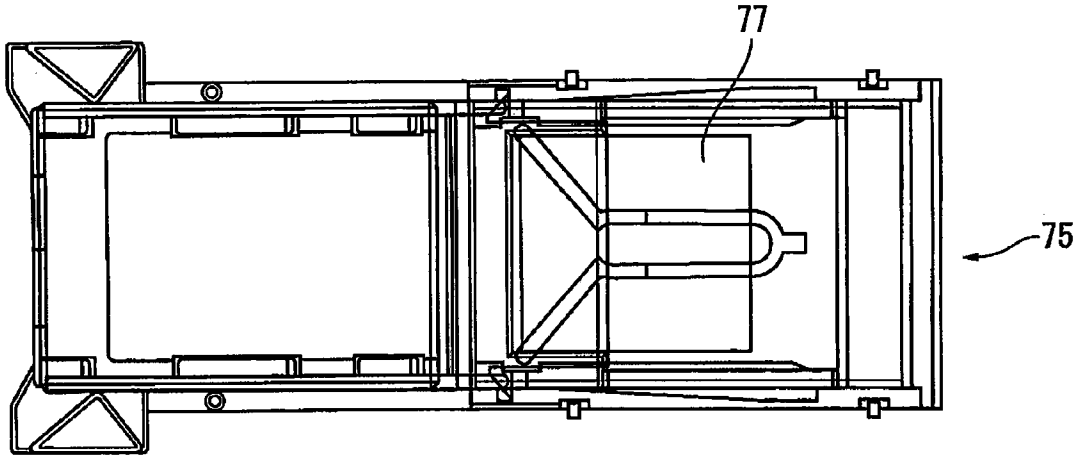
FIGS. 10A and 10B are plan views illustrating an opening/closing mechanism (provided in the container receiving portion) in a closed state and an open state, respectively.
Figure 10B:
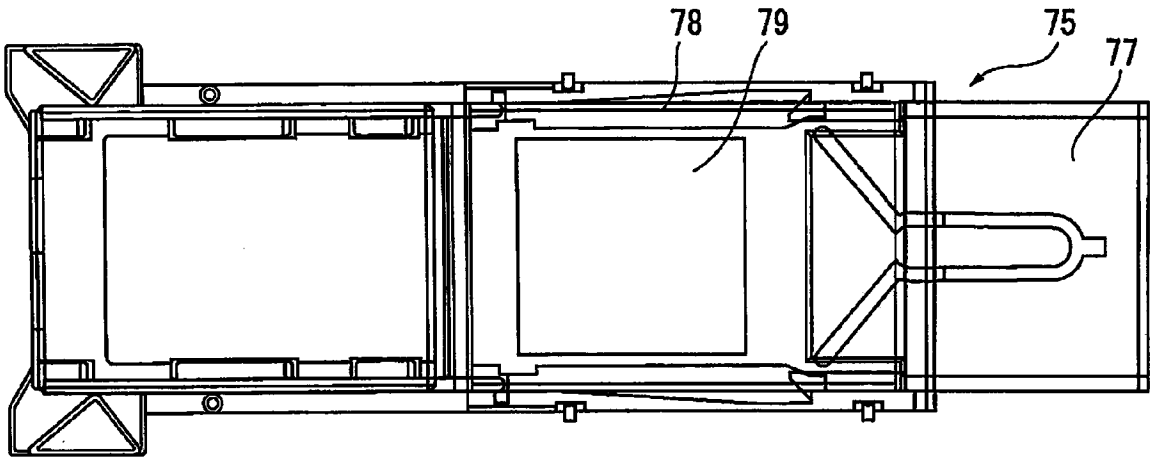

As shown in FIGS. 10A and 10B, when the shutter 110 of the toner cartridge 61 hits a lid member 77 of the opening/closing mechanism 75, the lid member 77 is pushed backward and an opening 79 of a lid holding frame 78 appears.

The front edge of the lid member 77 of the opening/closing mechanism 75 serves as a butting surface to be hit by the shutter 110.

<Structure Around Shutter of Toner Cartridge>

Figure 11:
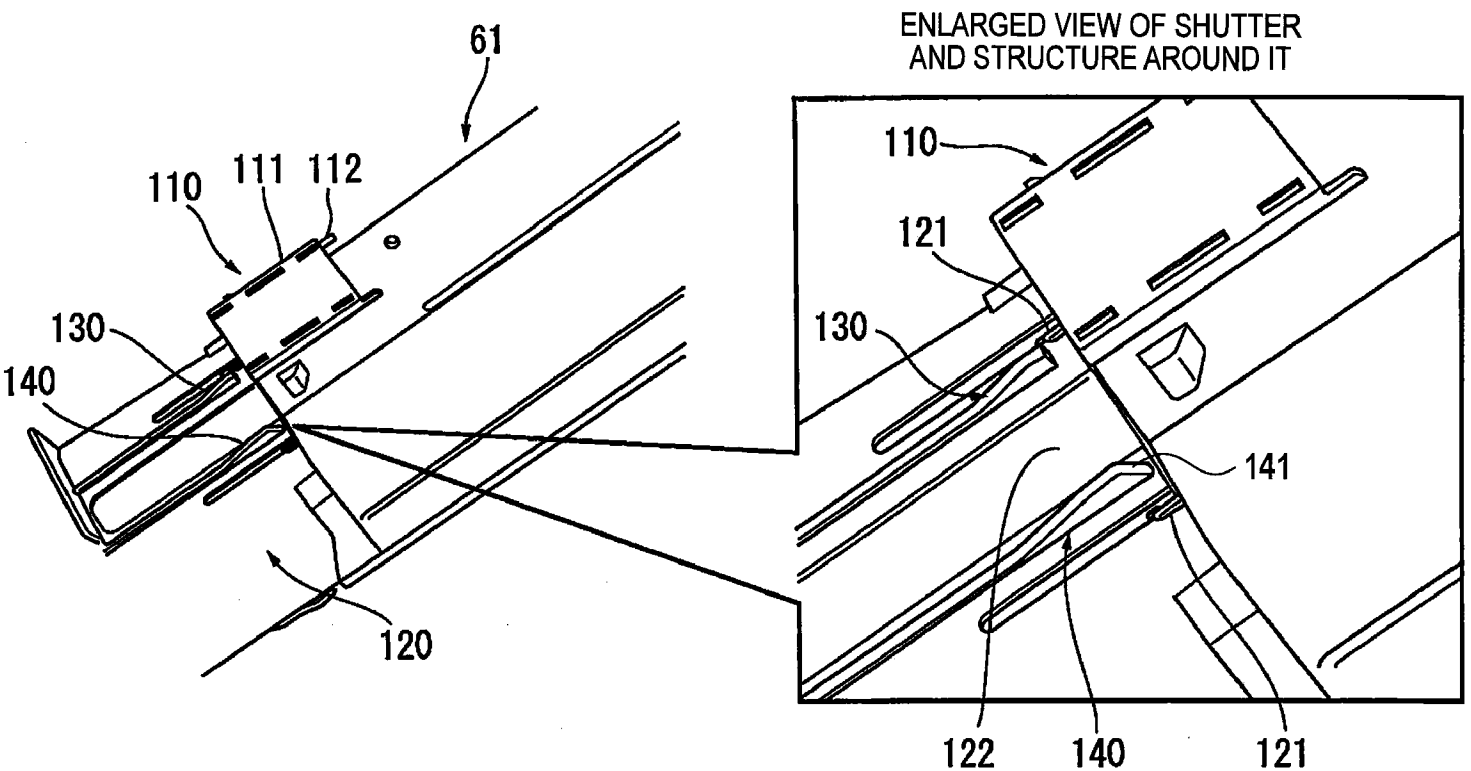
FIG. 11 is a perspective view showing a shutter and a structure around it of the developer container (including an enlarged view)

FIG. 11 shows a structure around the shutter 110 of the toner cartridge 61.

As shown in FIG. 11, the shutter 110 has an opening/closing lid 112 which slides with respect to a lid holding frame 111. An edge of the opening/closing lid 112 is formed at such a position as to face the handle 120. An edge portion of the handle 120 is formed with a pair of cuts 121, and a plate portion of the handle 120 that is interposed between the cuts 121 is made a deformable plate 122 capable of elastic deformation. The deformable plate 122 is formed with a stopper wall (stopper) 130 which is opposed to the front end portion of the opening/closing lid 112 of the shutter 110. The stopper wall 130 has a vertical surface to which to be touched by the front end portion of the opening/closing lid 112.

On the other hand, a portion of the deformable plate 122 that does not face the opening/closing lid 112 is formed with a contact piece 140 to be brought into contact with the above-mentioned hook portion 76. Unlike the stopper wall 130, the contact piece 140 has a slant surface 141 which is inclined so as to come closer to the front end portion of the opening/closing lid 112. The contact piece 140 is higher than the stopper wall 130.

Next, toner cartridge attaching work according to the first embodiment will be described.

Figure 12A:
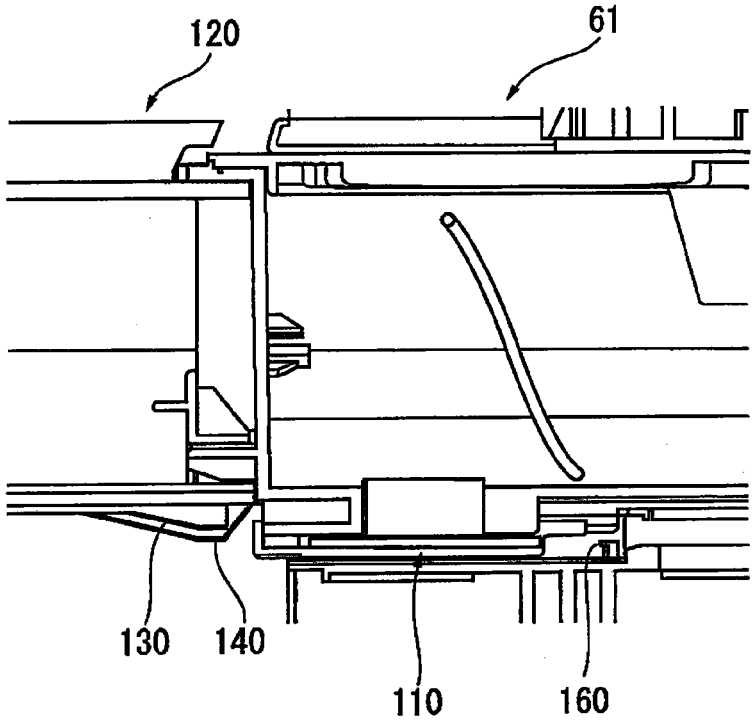
FIGS. 12A and 12B show a first step and a second step of work of inserting the developer container into/over the container receiving portion in the first embodiment.

As shown in FIG. 12A, the toner cartridge 61 is inserted along the guide rail 70 of the cartridge receiving portion 62 and the shutter 11*o* of the toner cartridge 61 has not reached the shutter butting surface 160 (the front end portion of the lid member 77) yet and the contact piece 130 has not touched the hook portion 76 yet.

Figure 12B:
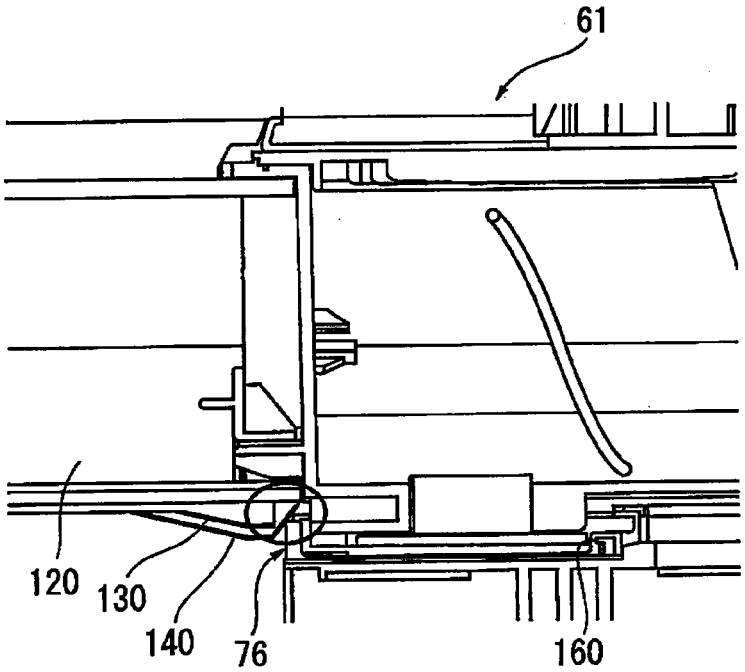

Then, as shown in FIG. 12B, as the toner cartridge 61 is inserted further into/over the cartridge receiving portion 62, the shutter 110 reaches the position indicated by the straight line that corresponds to the shutter butting surface 160. The contact piece 140 has not touched the hook portion 76 yet.

Figure 13A:
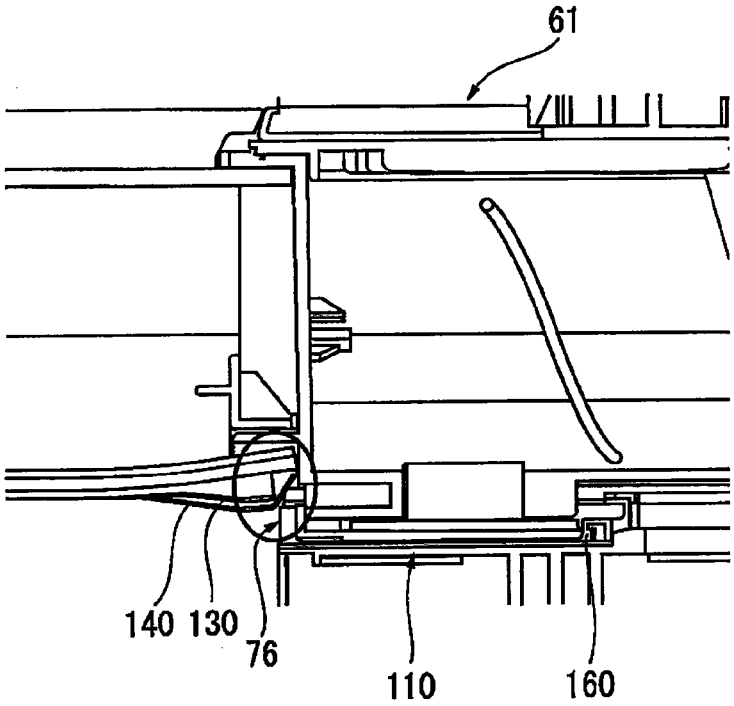
FIGS. 13A and 13B show a third step and a fourth step of the work of inserting the developer container into/over the container receiving portion in the first embodiment.

Then, as shown in FIG. 13A, the shutter 110 reaches the shutter butting surface 160. The contact piece 140 goes up onto the hook portion 76, whereby the deformable plate 122 is deformed. As the deformable plate 122 is deformed, the stopper wall 130 is deformed, whereby the rear end portion of the stopper wall 130 is moved to such a position that it cannot contact the shutter 110.

Figure 13B:
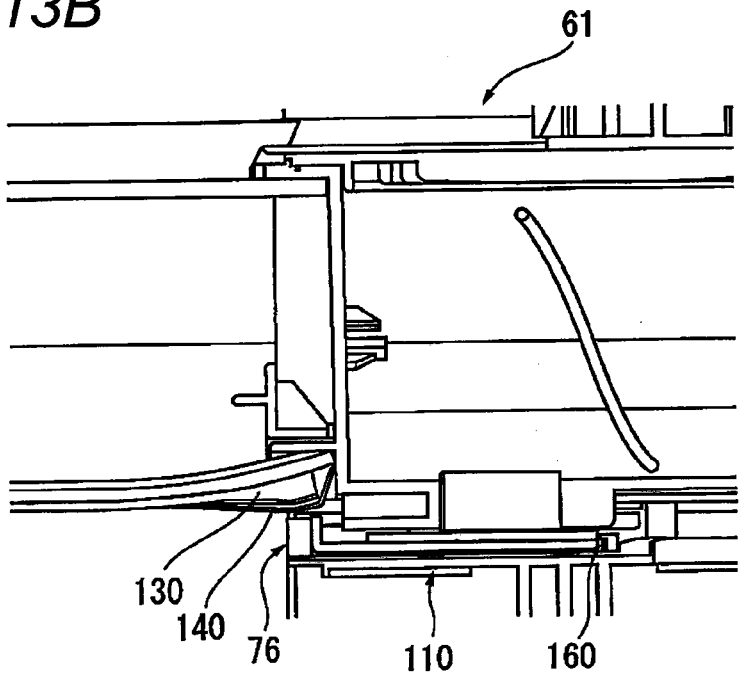

Then, as shown in FIG. 13B, the shutter 110 is held at a set position of the opening/closing mechanism 75 of the cartridge receiving portion 62. The toner cartridge 61 is pushed further, whereby the shutter 110 is opened.

Figure 14A:
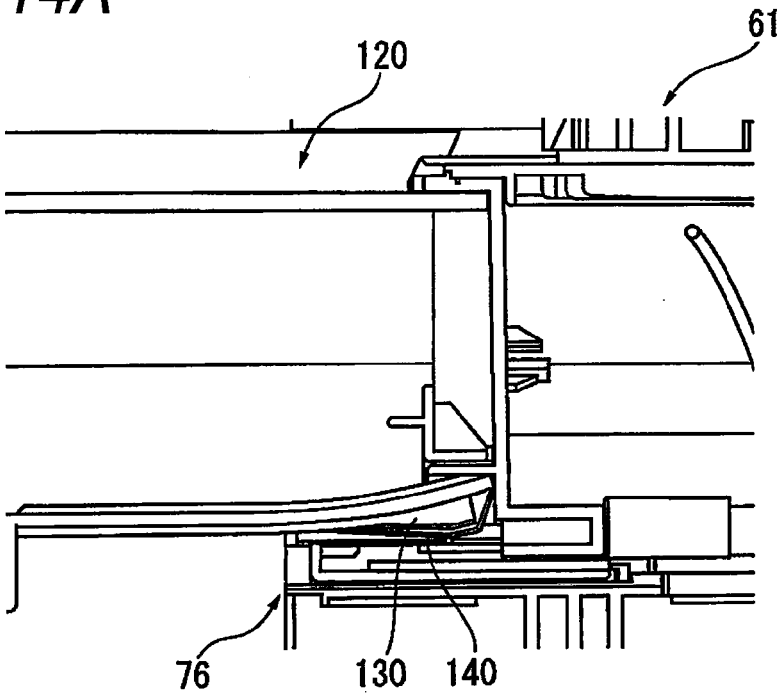
FIGS. 14A and 14B show a fifth step and a sixth step of the work of inserting the developer container into/over the container receiving portion in the first embodiment.
Figure 14B:
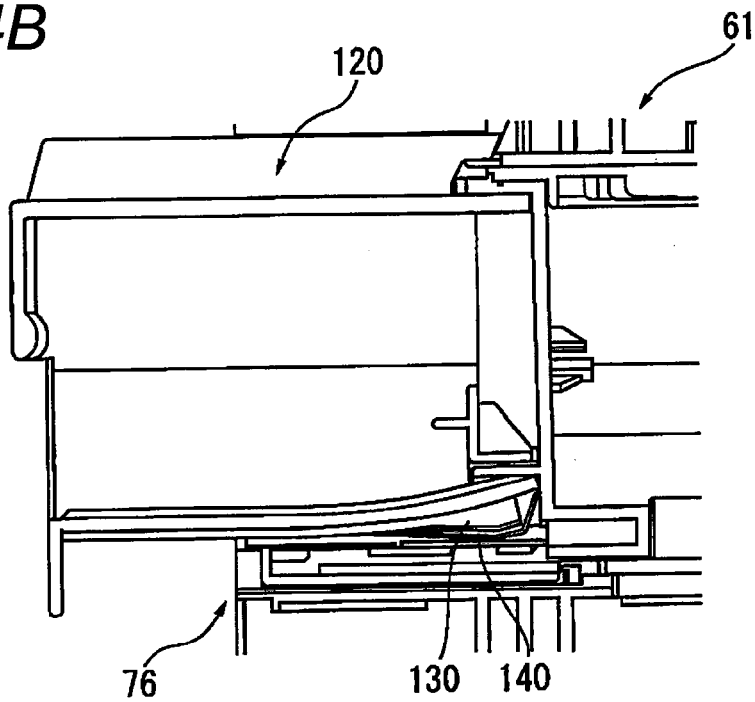

Then, as shown in FIG. 14A, the toner cartridge 61 is pushed further into the apparatus. The manipulation of inserting the toner cartridge 61 is completed when it has reached a cartridge insertion completion position (see FIG. 14B).

The toner cartridge 61 can be detached by a manipulation that is reverse to the above-described manipulation of the attaching work.

Second Exemplary Embodiment

Figure 15A:
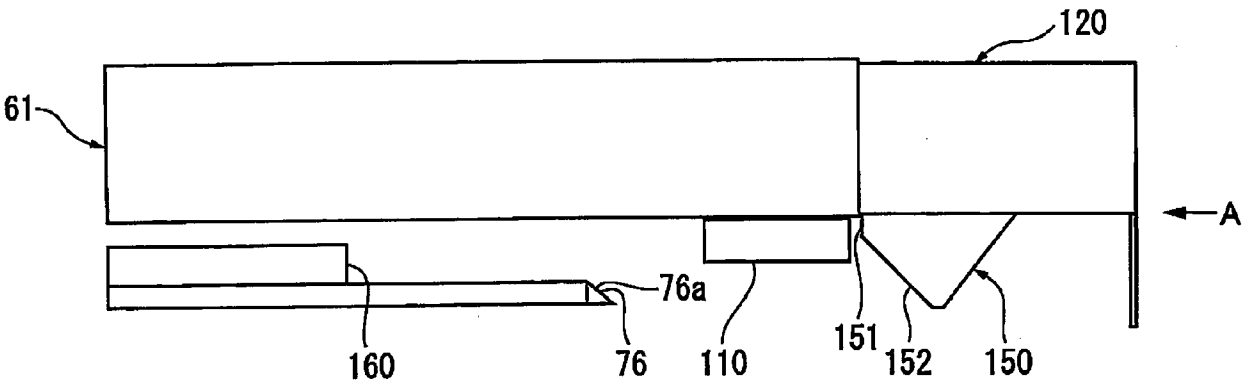
FIGS. 15A and 15B show a first step and a second step of work of inserting a developer container according to a second embodiment into/over the container receiving portion.

FIG. 15A shows a developer container (toner cartridge) according to a second embodiment.

The second embodiment is different from the first embodiment in the structure around the shutter 110 of the toner cartridge 61.

More specifically, in the second embodiment, the handle 101 of the toner cartridge 61 has a deformable plate (not shown) like the one used in the first embodiment and the deformable plate is provided with a stopper contact piece 150 which has the functions of both of the stopper wall 130 and the contact piece 140 of the first embodiment. The stopper contact piece 150 has a stopper surface 151 which is a vertical surface to touch the shutter 110, and a contact slant surface 152 is provided adjacent to the stopper surface 151.

The cartridge receiving portion 62 is provided with the shutter butting surface 160 to which the shutter 110 is to touch and the hook portion 76 to which the contact slant surface 152 of the stopper contact piece 150 is to come into contact. In the second embodiment, the front end portion of the hook portion 76 is formed with a slant surface 76*a* which corresponds to the contact slant surface 152.

Next, toner cartridge attaching work according to the second embodiment will be described.

Figure 17A:
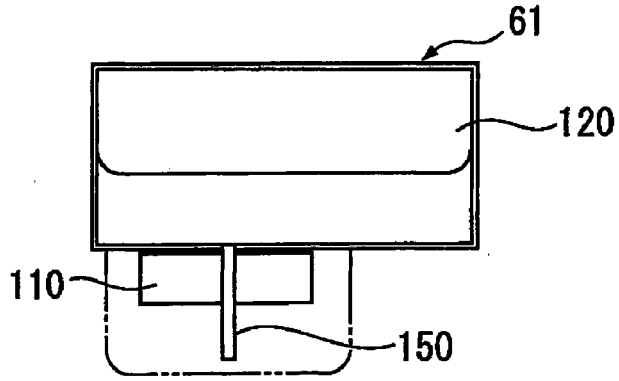
FIG. 17A is a view as viewed from the direction A in FIG. 15A.

As shown in FIGS. 15A and 17A, when the toner cartridge 61 is not attached, the shutter 110 is stopped by the stopper surface 151 of the stopper contact piece 150 and the shutter 110 is kept unopenable.

Figure 15B:
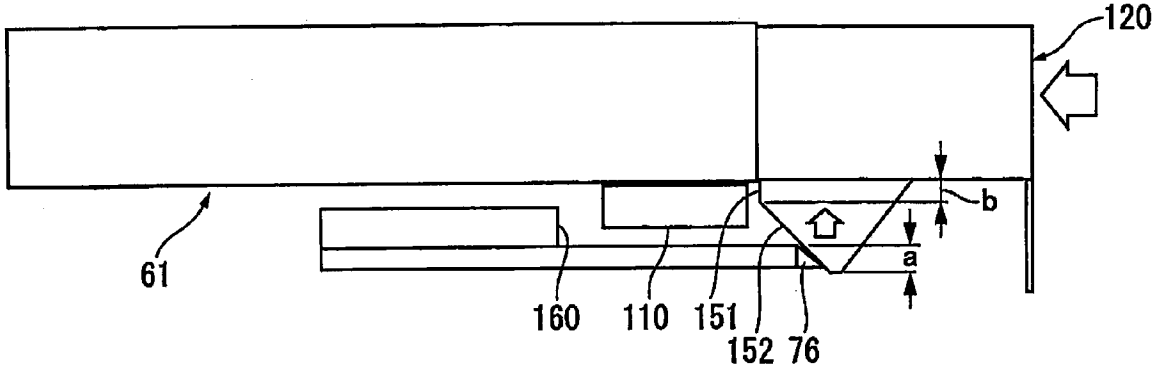

Then, as shown in FIG. 15B, as the toner cartridge 61 in inserted into/over the cartridge receiving portion 62, the contact slant surface 152 of the stopper contact piece 150 comes into contact with the hook portion 76 and then the stopper contact piece 150 goes up onto the hook portion 76.

More specifically, as shown in FIG. 15B, a relationship a>b is satisfied, where a is the height of a portion of the contact slant surface 152 that is to act on the hook portion 76 and b is the height of the stopper surface 151. Since this relationship is satisfied, when the stopper contact piece 150 goes up onto the hook portion 76, the stopper surface 151 escapes, together with the deformable plate, from such a position as to be opposed to the shutter 110 to such a position as not to be able to contact the shutter 110 and the contact slant surface 152 of the stopper contact piece 150 comes to be opposed to the shutter 110.

Figures 16A, 16B, 16C:
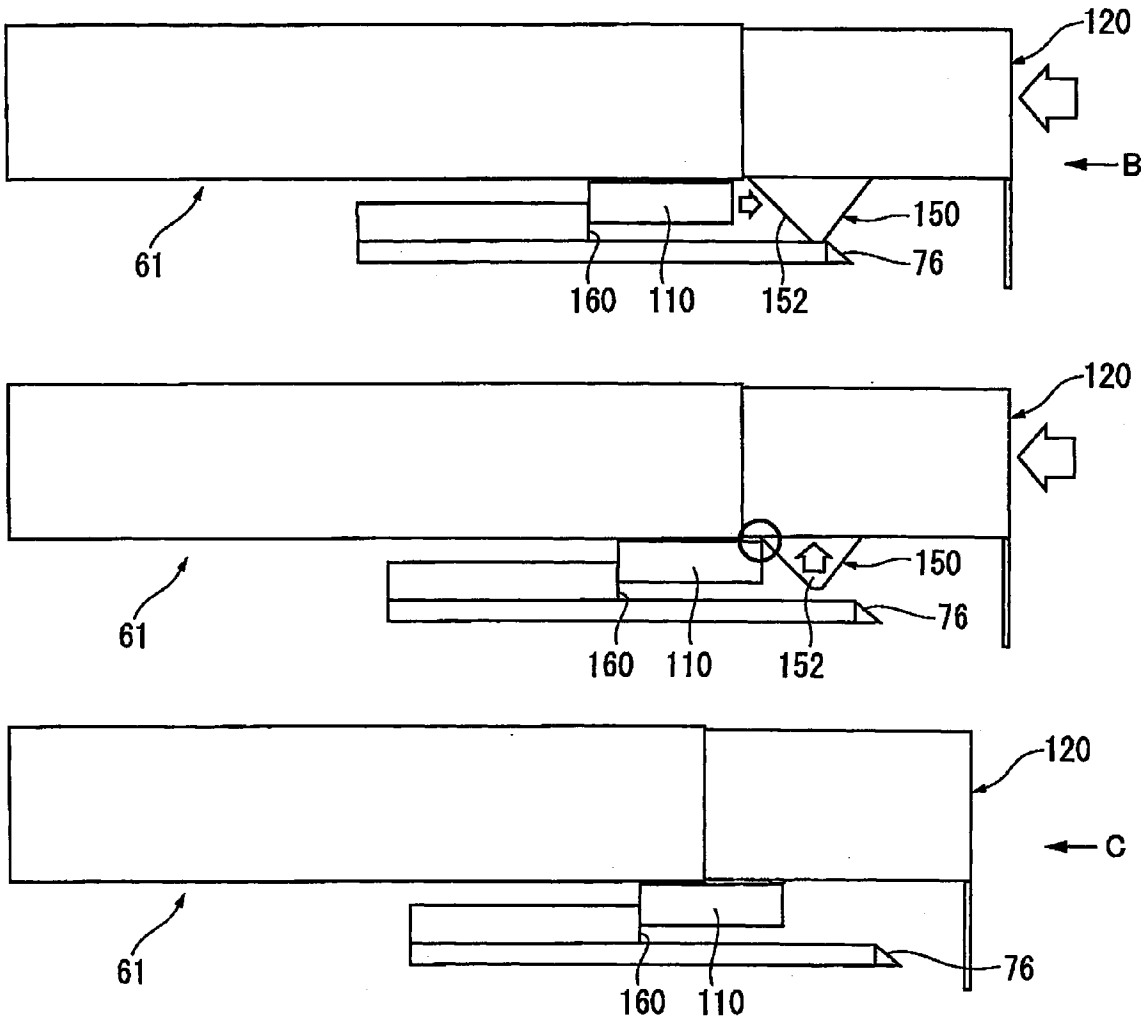
FIGS. 16A to 16C show a third step to a fifth step of the work of inserting a developer container according to the second embodiment into/over the container receiving portion.
Figure 17B:
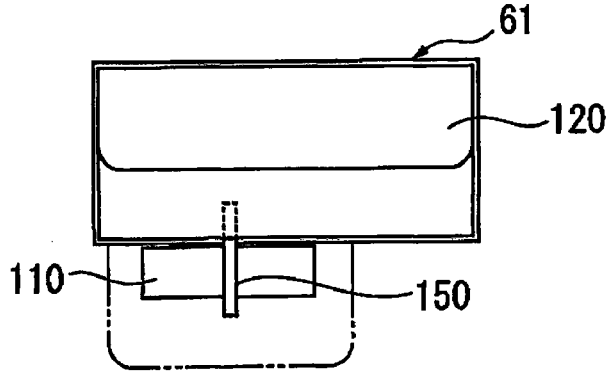
FIG. 17B is a view as viewed from the direction B in FIG. 16A.

Then, as shown in FIGS. 16A and 17B, the stopper contact piece 150 goes up onto the hook portion 76. As the toner cartridge 61 is pushed further, shutter 110 hits the shutter butting surface 160 and the position of the shutter 110 is fixed.

Then, as shown in FIG. 16B, as the toner cartridge 61 is pushed further, the shutter 110 comes into contact with the contact slant surface 152 of the stopper contact piece 150 and the stopper contact piece 150 is deformed further by the shutter 110 whose position is fixed by the shutter butting surface 160.

Figure 17C:
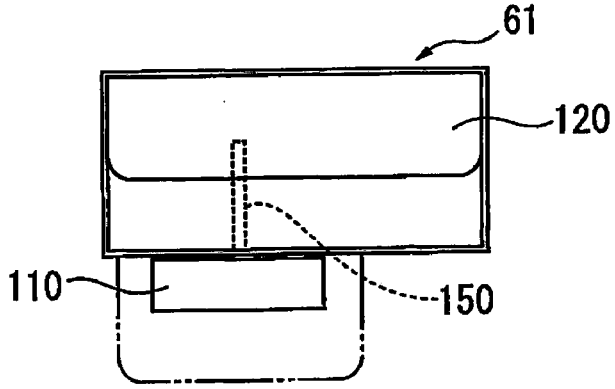
FIG. 17C is a view as viewed from the direction C in FIG. 16C.

Then, as shown in FIGS. 16C and 17C, the toner cartridge 61 is set completely by pushing the toner cartridge 61 further.

The toner cartridge 61 can be detached by a manipulation that is reverse to the above-described manipulation of the attaching work.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developer container which contains developer and is to be inserted into and detached from a container receiving portion of an image forming apparatus body, comprising:

a container body that contains developer;

an opening that is formed through the container body;

an opening/closing lid that closes the opening;

a lid holding frame that holds the opening/closing lid in such a manner that the opening/closing lid can move in an opening/closing manipulation direction between an open position where the opening/closing lid exposes the opening and a closed position where the opening/closing lid closes the opening;

a stopper that stops the opening/closing lid to prevent the opening/closing lid from moving toward the open position in a state that the opening/closing lid is located at the closed position;

a contact portion that comes into contact with a hook portion provided in the container receiving portion when the developer container is inserted into the container receiving portion; and a deformable portion that deforms the stopper to such an extent that the stopping of the opening/closing lid by the stopper is canceled when the developer container is inserted into the container receiving portion and the contact portion comes into contact with the hook portion.

2. The developer container according to claim 1, wherein:

the stopper and the contact portion are provided in a common deformable portion.

3. The developer container according to claim 1, wherein:

the deformable portion is a plate piece which is located between cuts formed in the container body and is thereby deformable.

4. The developer container according to claim 1, wherein:

the stopper and the contact portion are provided separately.

5. The developer container according to claim 1, wherein:

the stopper is lower than the contact portion; and the stopper is rendered incapable of contacting the opening/closing lid when the deformable portion is flexibly deformed through the contact of the contact portion and the hook portion.

6. An image forming apparatus comprising:

the developer container according to claim 1; and the image forming apparatus body having the container receiving portion, wherein:

the container receiving portion comprises:

a lid guiding member that guides the opening/closing lid of the developer container as it is moved;

the hook portion that comes into contact with the contact portion and thereby deforms the deformable portion when the developer container is inserted into the container receiving portion;

a lid opening maintaining unit that holds the opening/closing lid after moving the opening/closing lid to the open position by contacting the opening/closing lid in completing insertion of the developer container; and a lid holding canceling unit that cancels a state that the opening/closing lid is held by the lid opening maintaining unit when the opening/closing lid has reached the closed position in detaching the developer container.

* * * * *